US008403320B2

(12) United States Patent
Lu

(10) Patent No.: US 8,403,320 B2
(45) Date of Patent: Mar. 26, 2013

(54) SHEET FEEDING MECHANISM WITH A DIFFERENTIAL MECHANISM

(75) Inventor: Chun-Kuei Lu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/278,116

(22) Filed: Oct. 20, 2011

(65) Prior Publication Data

US 2013/0020757 A1 Jan. 24, 2013

(30) Foreign Application Priority Data

Jul. 18, 2011 (TW) ..... 100125355 A

(51) Int. Cl.
*B65H 3/06* (2006.01)

(52) U.S. Cl. ..... 271/114; 271/226

(58) Field of Classification Search ..... 271/114, 271/226
See application file for complete search history.

(56) References Cited

U.S. PATENT DOCUMENTS 2,011,744 A * 8/1935 Wormser ..... 271/270
5,020,788 A * 6/1991 Hatano et al. ..... 271/126

FOREIGN PATENT DOCUMENTS

JP 63230451 A * 9/1988
JP 05186121 A * 7/1993

* cited by examiner

*Primary Examiner* — Gerald McClain
(74) *Attorney, Agent, or Firm* — Altis Law Group, Inc.

(57) ABSTRACT

A sheet feeding mechanism includes a main body, a rotator rotatable coupled to the main body and capable of rotating about an axis, two feeders configured to feed a sheet and a differential mechanism transmitting a rotation from the rotator to the two feeding rollers.

2 Claims, 3 Drawing Sheets

SHEET FEEDING MECHANISM WITH A DIFFERENTIAL MECHANISM

BACKGROUND

1. Technical Field

The present disclosure relates to a sheet feeding mechanism, and particularly to a sheet feeding mechanism capable of correcting the skew of a sheet.

2. Description of Related Art

Sheet processing devices, such as scanners, printers, always include a sheet feeding mechanism for feeding a sheet from a tray. The sheet may tend to skew when placed on the tray. Thus, a de-skew mechanism is needed to correct the skew of the sheet. Though many de-skew mechanisms purport to be "anti-skew", a better sheet feeding mechanism capable of more effectively correcting the skew of a sheet is still desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure are now described, with reference to the accompanying drawings.

Figure 1:
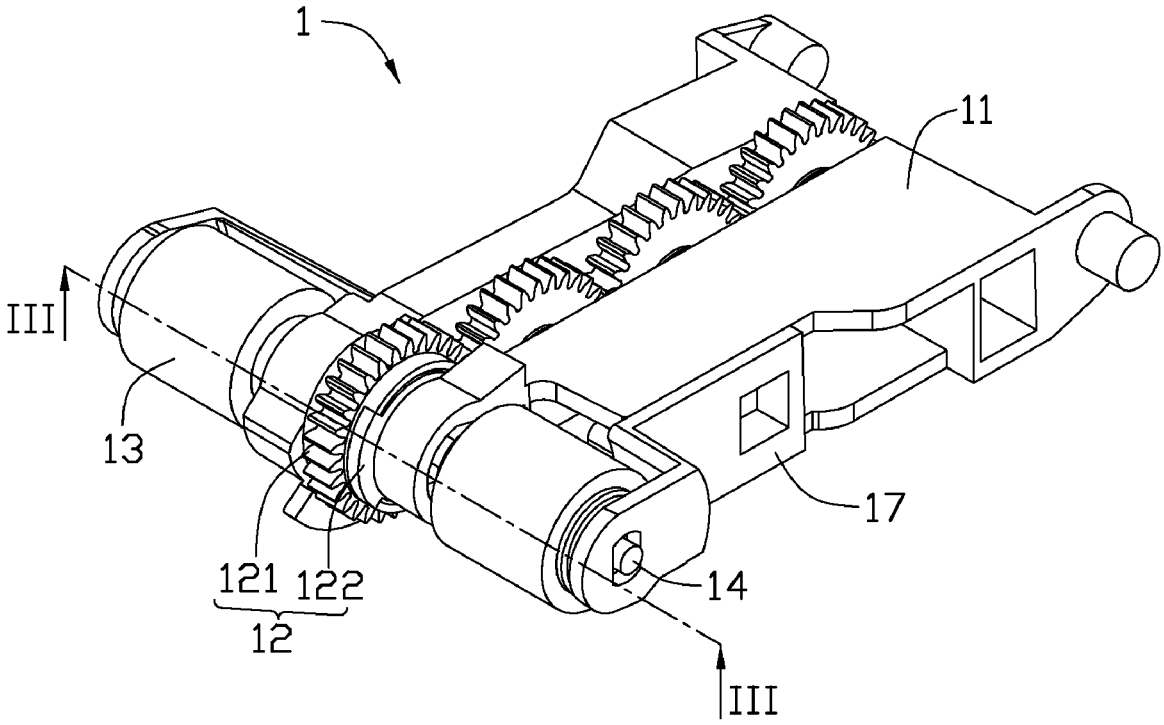
FIG. 1 is an isometric view of a sheet feeding mechanism according to an exemplary embodiment.
Figure 2:
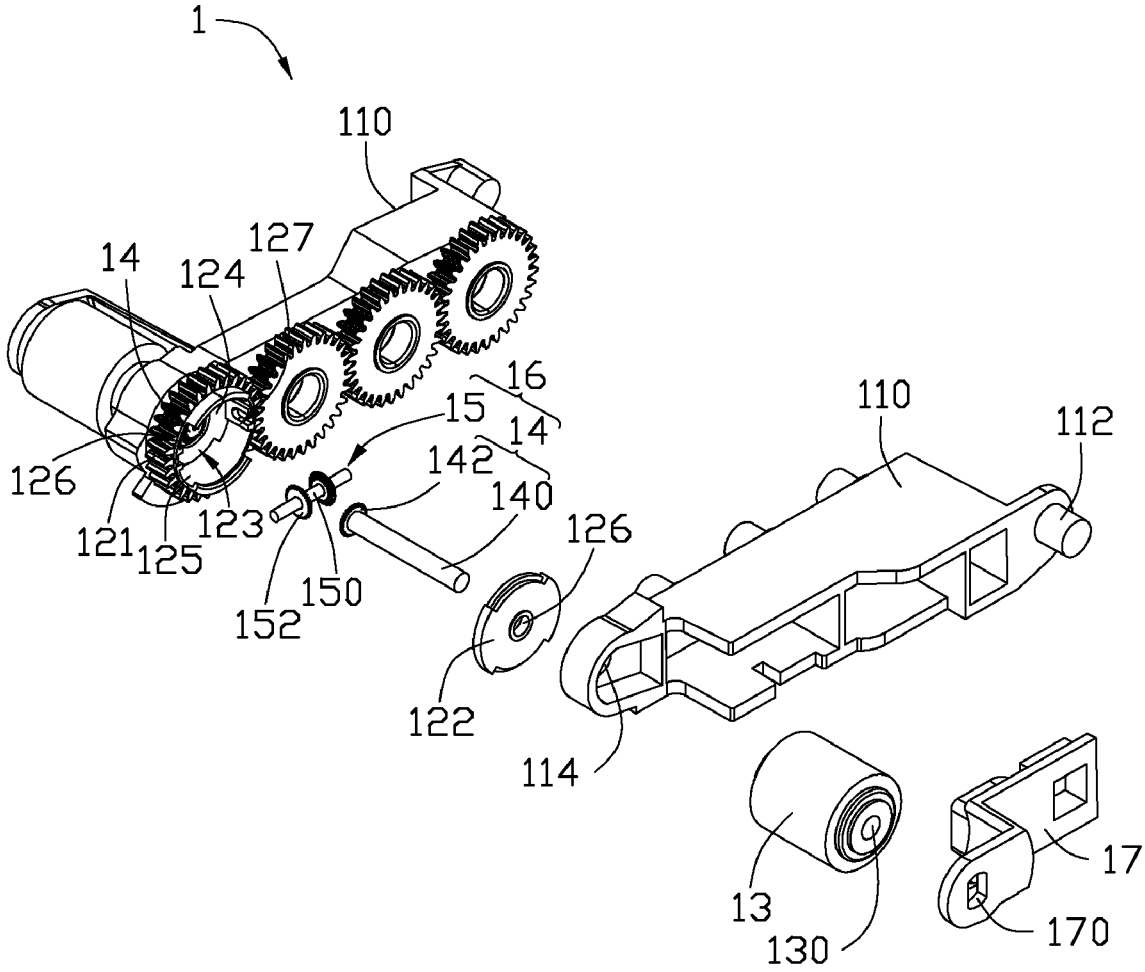
FIG. 2 is an exploded view of part of the sheet feeding mechanism of FIG. 1.

Referring to FIGS. 1-2, a sheet feeding mechanism 1 according to an exemplary embodiment is illustrated. The sheet feeding mechanism 1 includes a main body 11, a rotator 12 rotatably coupled to the main body 11 and capable of rotating about its axis, two feeding rollers 13 for feeding a sheet, and a differential mechanism 16 transmitting the rotation of the rotator 12 to the two feeding rollers 13.

The main body 11 includes two half portions 110 coupled to each other. One end of each half portion 110 includes a post 112, and a first through hole 114 is defined in the opposite end.

The rotator 12 is a hollow ring, and includes a case 121 defining a receiving space 123 and a lid 122 covering the receiving space 123. The case 121 includes a side surface 124 and a lateral surface 125 extending around the side surface 124, within which the receiving space 123 is found. The lid 122 and the side surface 124 each define a second through hole 126 aligned with the first through hole 114 of the main body 110. The lateral surface 125 defines two opposite fastening holes 127. In the embodiment, the rotator 12 functions as an externally-toothed gear. The rotator 12 may be connected to a driver (not shown) via a number of gears (not labeled). When the driver is working, the rotator 12 rotates around its axis.

Each feeding roller 13 is cylindrical and defines a third through hole 130 aligned with the first through hole 114 of the main body 11.

Figure 3:
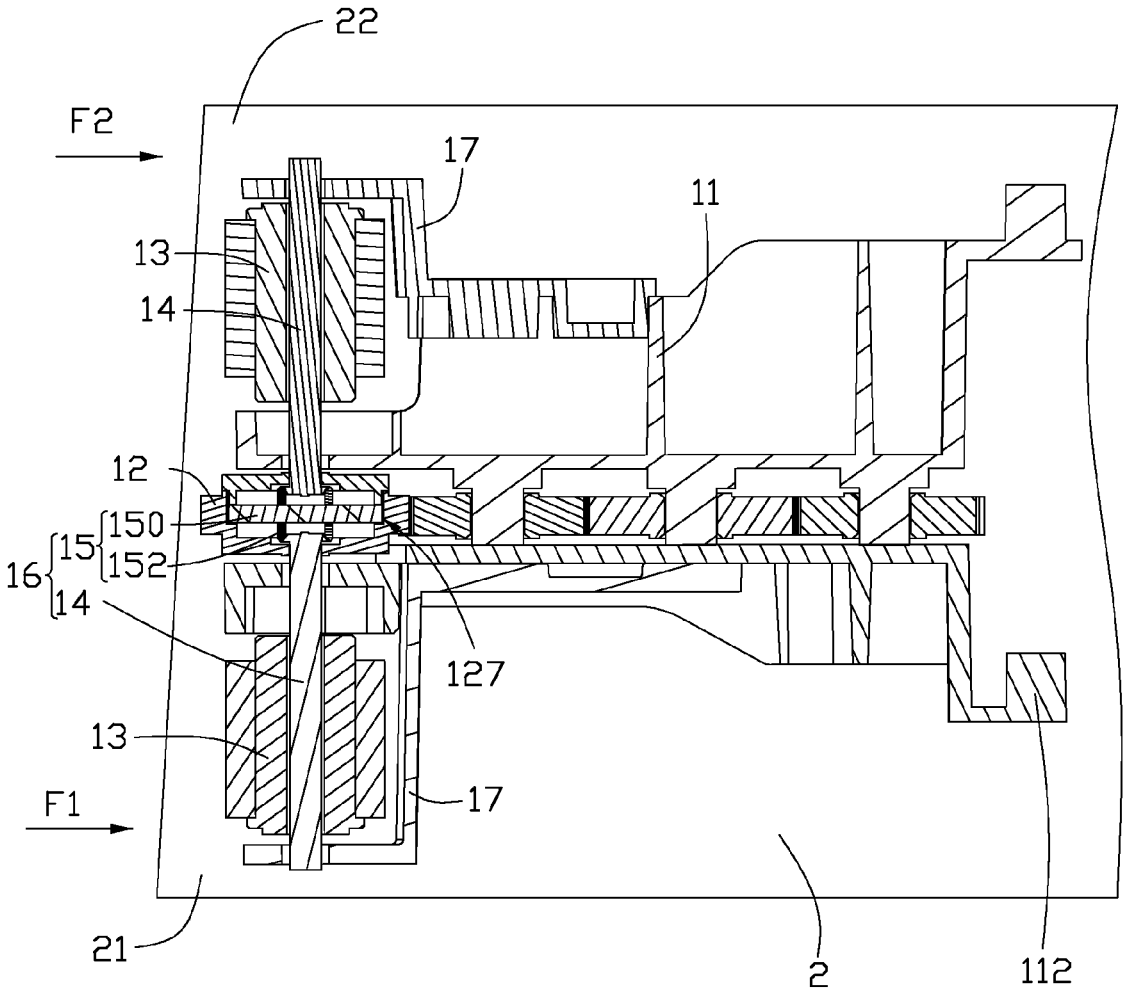
FIG. 3 is a cross-sectional view of the sheet feeding mechanism, taken along the line III-III of FIG. 1.

Referring to FIG. 3, the differential mechanism 16 includes two output shafts 14 connected to the feeding rollers 13, and an input shaft 15 connected to the rotator 12.

The output shaft 14 includes a shank 140 and a first helical gear 142 connected to one end of the shank 140. The shank 140 extends through the second through hole 126, the first through hole 114, and the third through hole 130. The shank 140 can be a press fit in the third through hole 130, thereby fixedly connecting the shank 140 to the feeding roller 13.

The input shaft 15 includes a rod 150 and two second helical gears 152 rotatably sleeved on the rod 150. The two opposite ends of the rod 150 are fixed in the fastening holes 127 of the rotator 12, allowing the input shaft 15 to move with the rotator 12. Each second helical gear 152 engages the first helical gears 142 of the output shafts 14.

In the embodiment, the sheet feeding mechanism 1 further includes two side caps 17 respectively coupled to one of the half portions 110 and each of the two side caps 13 defines a fourth through hole 170 that allows the shank 140 of the output shaft 14 to extend therethrough. The side caps 17 prevent the feeding rollers 13 from disengaging from the shank 140 of the input shaft 14.

After assembly, the sheet feeding mechanism 1 is rotatably coupled to a sheet processing device (not shown) via the posts 112 and the feeding rollers 13 make contact with a sheet 2. When the sheet 2 is not misaligned or skewed, the two feeding rollers 13 are applied with substantially the force, the second helical gears 152 sleeved on the input shaft 15 revolve around the axis about which the rotator 12 rotates. The first helical gears 142 engaging the second helical gears 152 are then rotating at the same speed. As a result, the two feeding rollers 13 rotate at the same speed.

When the sheet 2 is skewed, the two feeding rollers 13 are subjected to different resisting forces, the second helical gears 152 sleeved on the rod 150 revolve about the axis of the rotator 12 and also rotate about the axis of the rod 150. This causes the first helical gears 142 engaging the second helical gears 152 to rotate at different speeds. The two feeding rollers 13 are then rotated at different speeds to correct the skew of the sheet 2. In detail, the sheet 2 includes a first angle 21 and a second greater angle 22. When the sheet 2 is moved by the feeding rollers 13, the first angle 21 is applied with a force F1 and the second angle is applied with a force F2 greater than the force F1. One of the feeding rollers 13 making contact at the first angle 21 rotates slower than the other roller 13, and thus any skew of the sheet 2 is corrected.

While various embodiments have been described and illustrated, the disclosure is not to be construed as being limited thereto. Various modifications can be made to the embodiments by those skilled in the art without departing from the spirit and scope of the disclosure as defined by the appended claims.

What is claimed is:

1. A sheet feeding mechanism comprising:

a main body comprising two half portions coupled to each other, and the rotator is disposed between the two half portions and defining two first through holes;

a rotator comprising a side surface and a lateral surface extending around the side surface, which cooperatively define a receiving space for retaining the input shaft, and the lateral surface defines two opposite fastening holes for receiving two opposite ends of the rod, wherein the rotator is coupled to the main body, disposed between the two half portions and capable of rotating about an axis;

a lid covering the receiving space, wherein the side surface and the lid each define a second through hole aligned with the first through hole, and the feeding rollers each define a third through hole, the shank of the output shaft extends through the second through hole, the first through hole and the third through hole;

two feeders configured to feed a sheet; and a differential mechanism comprising two output shafts and an input shaft, each output shaft comprising a first helical gear and a shank for fixing the feeding roller, and the input shaft comprising a rod fixed to the rotator and at least one second helical gear rotatably sleeved on the rod, and the at least one second helical gear engages the first helical gears of the two output shafts for transmitting rotation from the rotator to the two feeding rollers, allowing the two feeding rollers to rotate at different speeds to correct skew of the sheet.

2. The sheet feeding mechanism as described in claim 1, further comprising two side caps respectively coupled to one of the half portions and each defining a fourth through hole that allows the shank of the output shaft to extend therethrough.

* * * * *